US006439920B1

(12) United States Patent
Chen

(10) Patent No.: US 6,439,920 B1
(45) Date of Patent: Aug. 27, 2002

(54) ELECTRONIC CONNECTOR PLUG FOR HIGH SPEED TRANSMISSION

(75) Inventor: Michael Chen, Keelung (TW)

(73) Assignee: Surtec Industries Inc., Keelung (TW)

( * ) Notice: Subject to any disclaimer, the term of this patent is extended or adjusted under 35 U.S.C. 154(b) by 0 days.

(21) Appl. No.: 09/954,054

(22) Filed: Sep. 18, 2001

(51) Int. Cl.[7] ..... H01R 4/24
(52) U.S. Cl. ..... 439/418
(58) Field of Search ..... 439/418, 676, 439/941, 465

(56) References Cited

U.S. PATENT DOCUMENTS

| | | | | | |
|---|---|---|---|---|---|
| 4,160,575 | A | * | 7/1979 | Schraut | 439/460 |
| 5,281,170 | A | * | 1/1994 | Murphy | 439/469 |
| 5,830,005 | A | * | 11/1998 | Watanabe | 439/418 |
| 5,888,100 | A | * | 3/1999 | Bofill et al. | 439/418 |
| 5,971,812 | A | * | 10/1999 | Martin | 439/676 |
| 6,080,007 | A | * | 6/2000 | Dupuis et al. | 439/418 |
| 6,116,943 | A | * | 9/2000 | Ferrill et al. | 439/418 |
| 6,280,232 | B1 | * | 8/2001 | Beecher et al. | 439/418 |
| 6,283,768 | B1 | * | 9/2001 | Van Naarden | 439/676 |
| 6,358,092 | B1 | * | 3/2002 | Siemon et al. | 439/418 |

FOREIGN PATENT DOCUMENTS

| | | |
|---|---|---|
| RO | 224547 | 12/1993 |
| RO | 424353 | 9/1999 |

* cited by examiner

*Primary Examiner*—Brian Sircus
*Assistant Examiner*—Phuong K T Dinh
(74) *Attorney, Agent, or Firm*—Birch, Stewart, Kolasch & Birch, LLP

(57) ABSTRACT

An electronic connector plug for high speed transmission provides an electronic connector plug conforming to Category 6 standards. The plug includes an insert element which holds the third twisted pair on a level different from the level of other three twisted pairs in a stagger manner, and allows each twisted pair maintaining twisted state before reaching the contacts of the plug, thereby to achieve more reliable high speed transmission performance.

12 Claims, 10 Drawing Sheets

ELECTRONIC CONNECTOR PLUG FOR HIGH SPEED TRANSMISSION

FIELD OF THE INVENTION

The invention relates to an electronic connector plug and particularly an electronic connector plug that is conformed to Category 6 standard for high speed transmission.

BACKGROUND OF THE INVENTION

In order to respond the growing applications of high speed networks after the Ethernet networks widely adopted, working groups in Telecommunications Industry Associations (TIA) of U.S.A. has developed and announced an Enhanced Cat. 6 standard based on the wiring system of Category 5 (Cat. 5) 100 MHZ (titled: TSB-67). The Cat. 6 standard expands from 100 MHZ of Cat. 5 to 200 MHZ and increases more than 25% of performance than the Cat. 5 standard. Hence, test frequency for Cat. 6 also has to reach 250 MHZ. The Cat. 6 standard has big advantages over the Cat. 5 standard, especially on the performance improvements in cross talk interference and return loss. On the full duplex high speed network applications in the new generation, improved performance on return loss is very important. Cross talk is a critical factor for implementing wide band applications. Although 100 MHZ is still the mainstream of the present network installations, Cat. 6 standard is a more desirable protocol to meet future requirements.

The current Fast Ethernet standard specification of IEEE802.3u utilizes EIA/TIA-568 as the standard of twisted pair. The twist pair, depending on their constructions, can be categorized in Unshielded Twisted Pair (UTP) and Shielded Twisted Pair (STP). The main difference between the two is that STP has one more metal shield and a grounding brass line, and is more expensive and more difficult to install. As a result, UTP is more popular and is the commonly adopted twisted pair standard.

Whereas the aforesaid standards are not solely for high speed communication cables. In order to maintain same level of high speed transmission performance in the high speed communication network systems, the peripheral facilities associated with the high speed communication cables, especially connection elements (such as RJ-45 type plugs and jacks) also should have matching designs. The RJ-45 connectors (including plug and jack) used in high speed communication networks generally are 8P8C type. 8P means eight positions, and 8C means eight gold plated contacts. However, in practical applications, only two pairs of lines are used. Another two pairs of lines may be used for other apparatus such as telephones and facsimiles. There are two types of connectors according to EIA/TIA specifications, i.e. EIA/TIA-568A and EIA/TIA-568B. EIA/TIA-568A is rarely used now, while EIA/TIA-568B is continuously being used. Its leg positions 1–8 are arranged sequentially and encased respectively by colored cables of white-orange, orange, white-green, blue, white-blue, green, white-brown, and brown.

In the past, most of the designs have been focused on the structure of the jacks and tried to conform to the standards set forth above. For instance, ROC Patent publication No. 224547 discloses "Communication connector terminals for eliminating noise" which makes the metal terminals of the jack overlapping in a non-contact manner, but has little design improvements on the plug. In the conventional jacks, four pairs (eight lines) of cable lines are laid on the same level to connect the contacts. Such a structure has greater cross-talk and return loss, and can hardly meet the Cat. 6 standard.

R.O.C. Patent publication No. 424353 discloses "Connector using conduction line for transmitting high frequency data" which proposes a design separating each twisted pair at the end of the cable, and connects each contact through a conduction wire connecting means. The separated lines are located in the plug at a selected sequence, and are connected to an insulation frame in a parallel manner. The frame has two channels separated by a flat plate for a selected distance in an up and down manner. Four pairs of conduction lines are held separately in the two channels at different levels. The ends of the channels have electric contact elements to connect the electric contacts located at the front end of the plug. While the techniques suggested by the public No. 424353 has some improvements over conventional plugs, there are still problems unresolved, notably:

1. The original design object of the twisted pair is to reduce the interference of noise and cross-talk. As conduction lines with electric current flowing thereon will generate electromagnetic field and interfere other conduction lines, twisting the positive and negative signal line can cancel out the magnetic fields generated by the two different lines and decrease the interference. But the design suggested by the public No. 424353 has to separate the end portion of the twist pair lines. Such a design contradicts the originally design object of the twist pair cable and will result in higher cross talk and return loss.
2. Although separating multiple twist pairs in parallel on different levels offers some improvements, the improved effect is limited.
3. The electric contact elements are located at the end of the channel of the frame.

The construction is complicated.

SUMMARY OF THE INVENTION

The primary object of the invention is to provide an improved electronic connector plug that is conformed to the Category 6 standard for high speed transmission. The plug of the invention includes an insert element insertable into the electronic connector plug. The insert element has a plurality of guiding tunnels located on different elevations. Each twisted pair of the high speed communication cable will be channeled through one tunnel and connected to metal contacts located at the front end of the plug. The plug thus constructed can achieve the original object of the twisted pair for reducing noise and cross-talk. Through disposing the multiple pairs of twisted pair located on different levels in a staggered manner, it also can meet the Cat. 6 standard for high speed communication.

Another object of the invention is to provide an electronic connector plug that has better assembly quality.

In order to attain the foregoing objects, the insert element of the invention is adopted a two-piece design. The insert element has a cradle body and a clamping cap. Before each twisted pair and the insert element being inserted into the casing of the plug, the high speed communication cable may be clamped tightly by the cradle body and clamping cap to prevent the end section of any cable line from withdrawing or skewing during assembly and to achieve accurate connection to the metal contacts.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
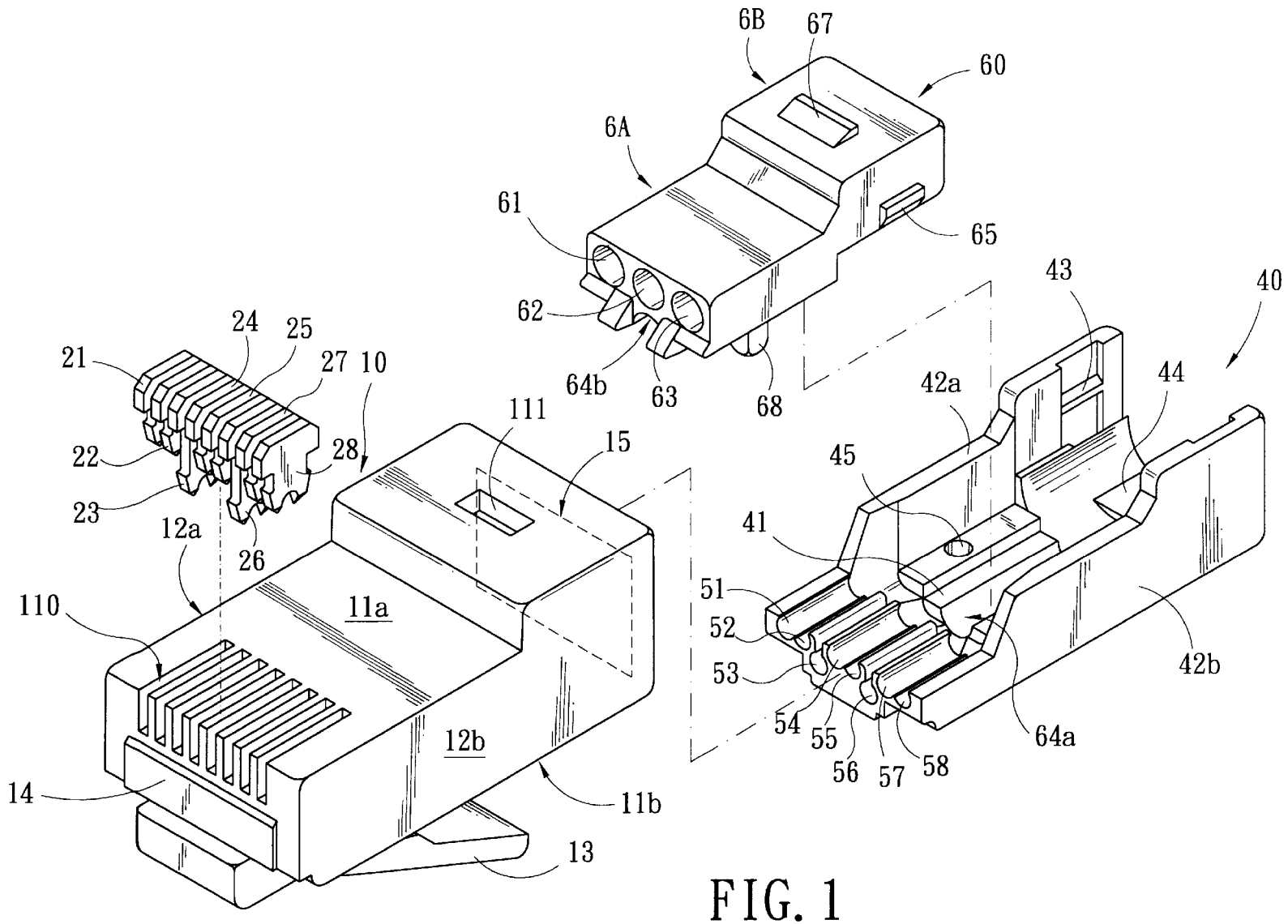
FIG. 1 is an exploded view of the invention.
Figure 2:
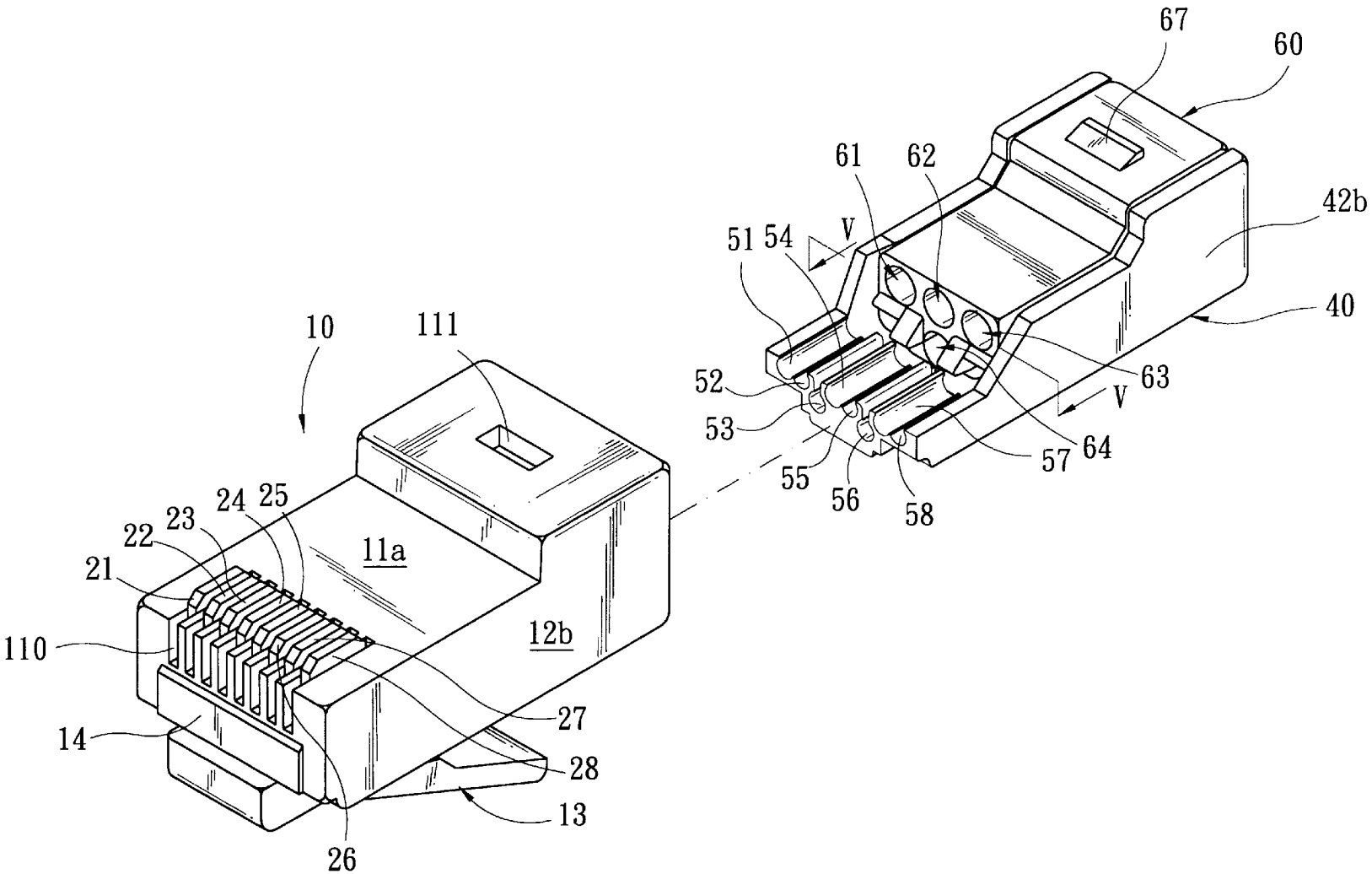
FIG. 2 is a perspective view of the invention, with the cradle body coupled with the clamping cap, and located in the inserting direction before coupling with the plug casing.
Figure 3:
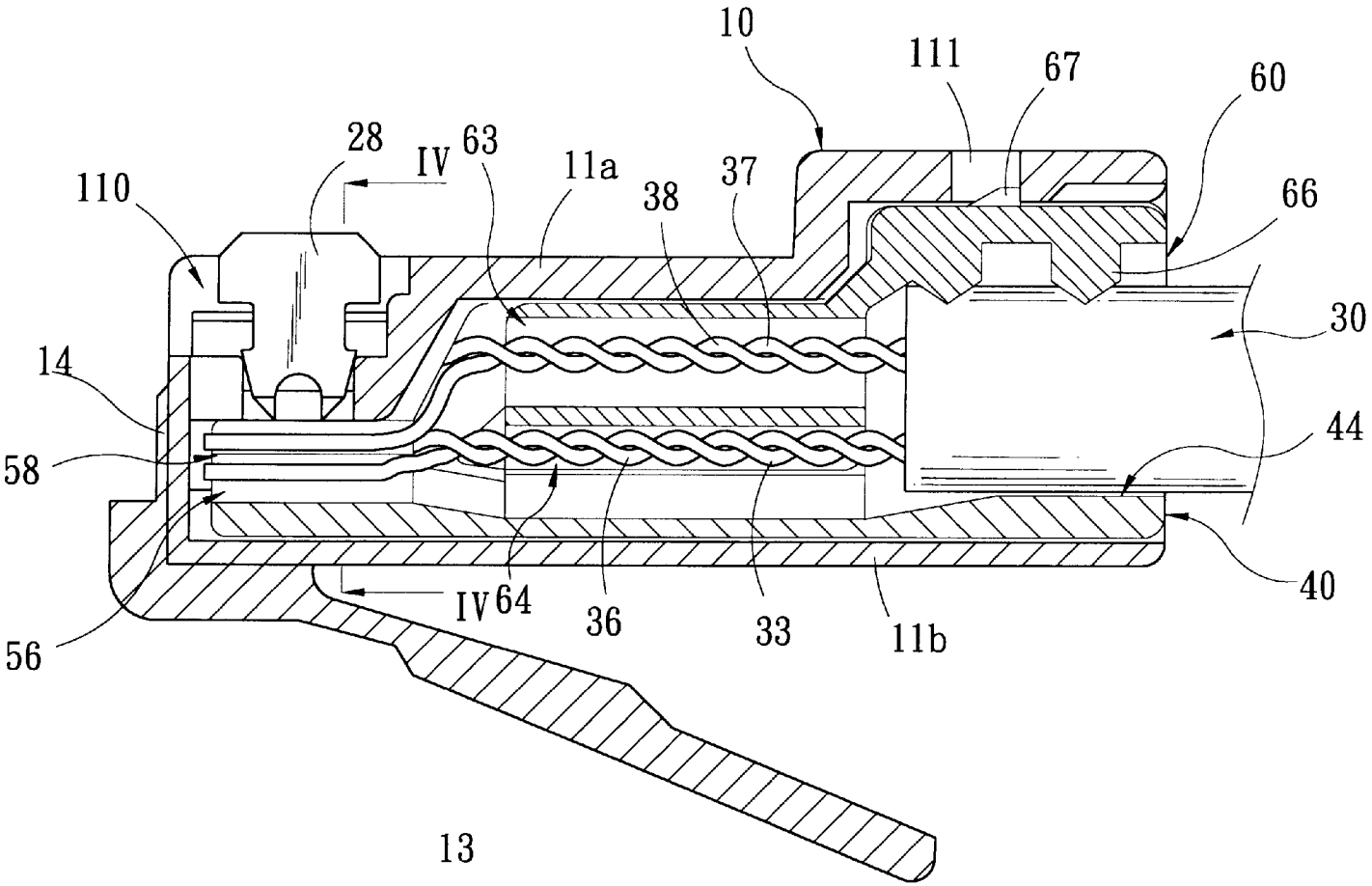
FIG. 3 is a sectional view of the invention assembled with a high speed communication cable and an insert element.
Figure 4:
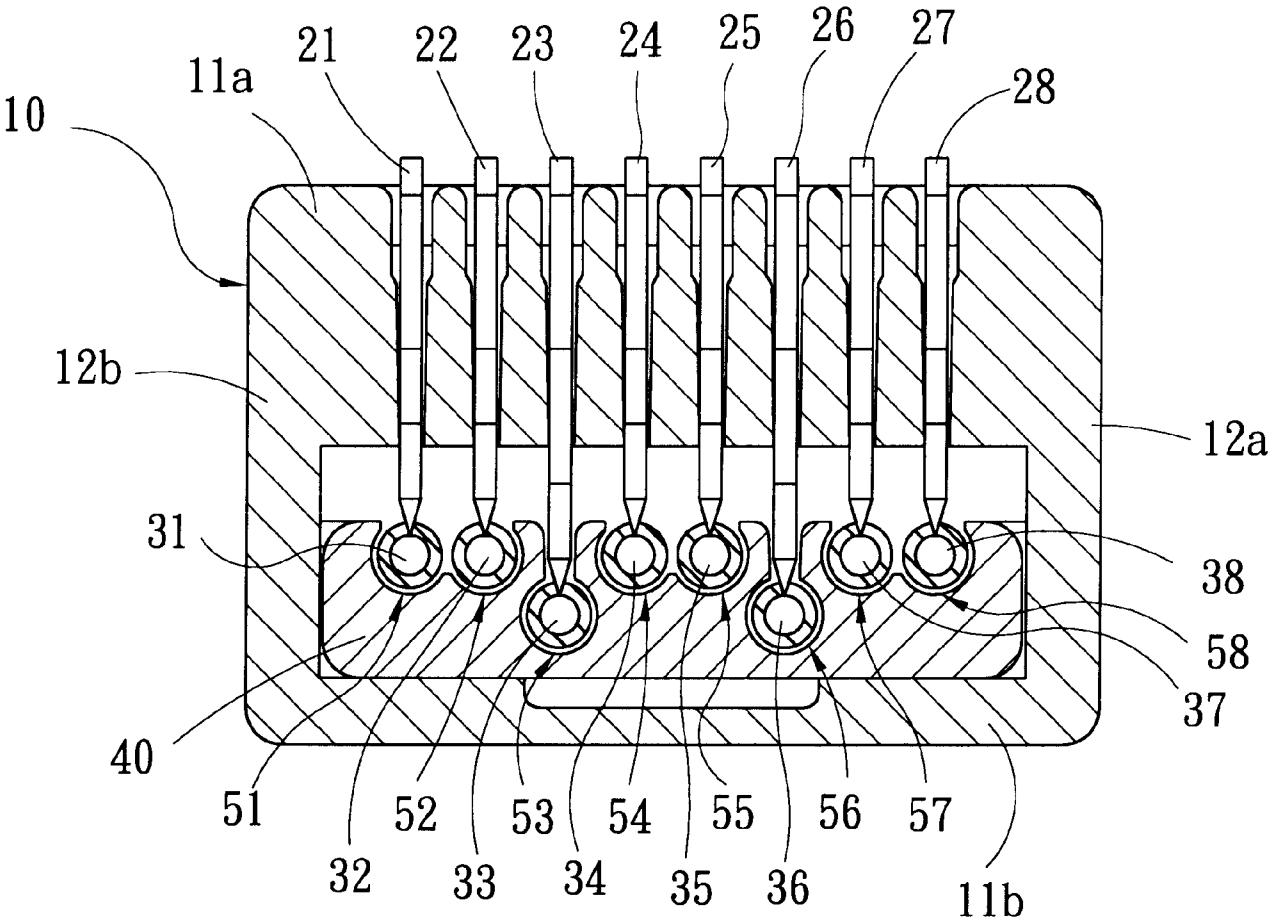
FIG. 4 is a cross section view of the invention taken along line IV—IV in FIG. 3, showing metal contacts connecting the cable lines.
Figure 5:
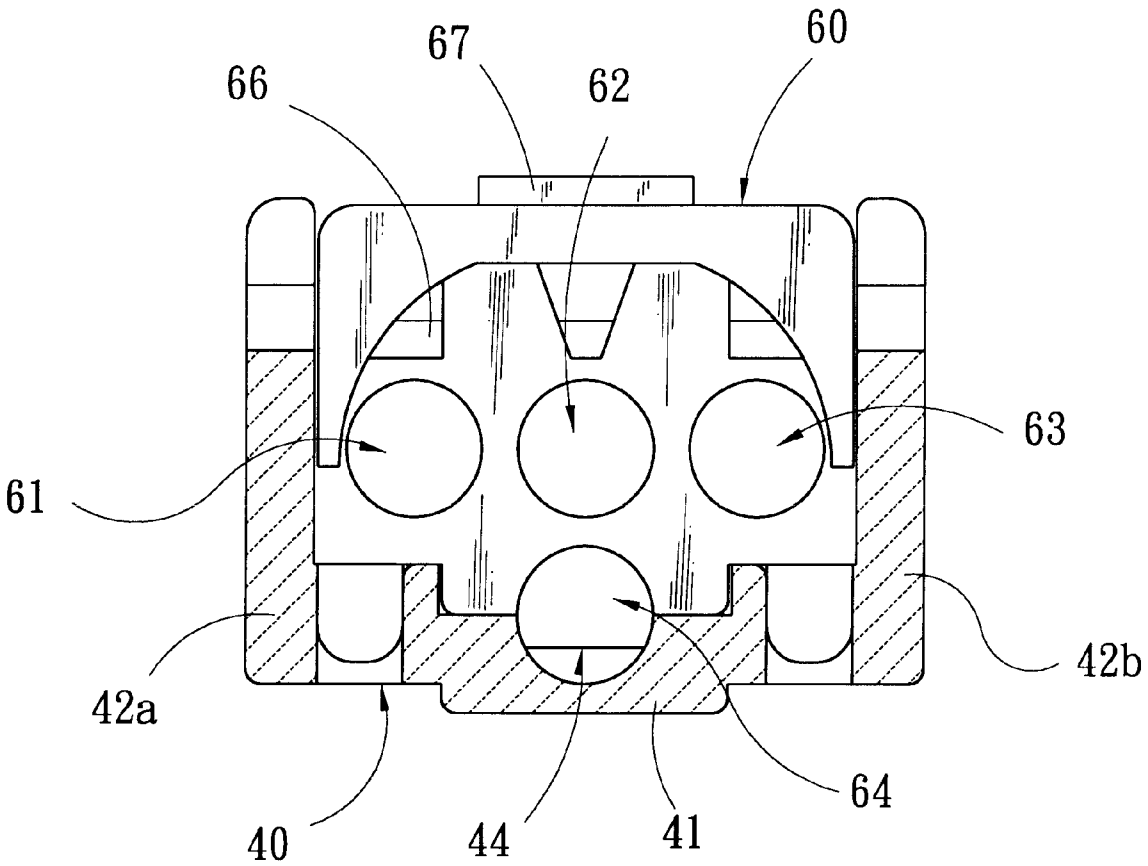
FIG. 5 is a cross section view of the invention taken along line V—V in FIG. 2, showing tunnels locations when the clamping cap and cradle body of the insert element are coupled.

Referring to FIG. 1, the electronic connector plug of the invention consists of:

a plug casing 10 which has dimensions conforming to the RJ-45 type electronic connector plug specifications. The casing 10 is a hollow element and has an upper wall 11*a*, a lower wall 11*b*, a left side wall 12*a*, a right side wall 12*b*, and an elastic tab 13 located beneath the bottom side of the lower wall 11*b* extending rearwards in a slant manner for engaging with an electronic connector jack (not shown in the drawing). The front end of the casing leading to the insertion direction with the jack has a closed front wall 14. The rear end opposite to the front wall has a port 15 communicating with the exterior. The front end of the casing 10 further has eight metal contacts 21–28 which are inserted through apertures 110 formed at the front end of the upper wall 11*a*. The metal contacts 21–28 have pointed front ends to connect with the cable lines 31–38 of the high speed communication cable 30; and an insert element which may be inserted into the casing 10 through the port 15 in the direction same as the direction of the casing 10 inserting into the plug. The insert element includes:

a cradle body 40 which is a narrow and elongated element with a passage running through the front end and the rear end, and has a bottom section 41, a left side wall 42*a* and a right side wall 42*b*. The front end of the bottom section 41 closest the casing 10 is extended forwards to form a plurality of line troughs 51–58 which are located respectively below the metal contacts 21–28 for holding cable lines 31–38 such that the pointed front ends of the metal contacts 21–28 can pierce through the insulation skin of the cable lines 31–38 to contact the metal conduction wire. In the middle portion of the bottom section 41, there is a lower guiding trough 64*a* longitudinally formed along the center axis of the bottom section 41 for channeling the third twisted pair lines 33 & 36 passing through the cradle body 40 on a lower level than the rest twisted pair lines 31 & 32, 34 & 35, 37 & 38; and a clamping cap 60 which is an elongated element and may be wedged in the narrow passage of the cradle body 40 surrounding by the bottom section 41, left side wall 42*a* and right side wall 42*b* (referring to FIG. 2). The clamping cap 60 includes a front section 6A and a rear section 6B aligning along the axis direction. The front section 6A has three tunnels 61–63 running therethrough for channeling the twisted pairs 31 & 32, 34 & 35, 37 & 38 (Pair 1, 2, 4) other than the third twisted pair 33 & 36. The front section 6A further has an upper guiding trough 64*b* formed in the middle of the bottom side thereof to couple with the lower guiding trough 64*a* of the cradle body 40 to form a fourth tunnel 64 for channeling the third twisted pair 33 & 36 (shown in FIG. 5). The rear section 6B has a plurality of latch lugs 65 (such as latch hooks) formed on two side walls 42*a* and 42*b* for engaging with matching latch notches 43 (such as hook slots) formed on the left side wall 42*a* and right side wall 42*b* of the cradle body 40, thereby allow the clamping cap 60 and the cradle body 40 to couple together. The clamping cap 60 further has a plurality of jutting clamping teeth 66 formed on the side facing the cradle body 40. The bottom section 41 of the cradle body 40 also has a clip plane 44 facing and mating the clamping teeth 66. Hence when the clamping cap 60 and the cradle body 40 are coupled together, the clamp teeth 66 and the clip plane 44 will clamp the high speed communication cable 30 tightly between the clamping cap 60 and the cradle body 40 (shown in FIG. 3).

Figure 8:
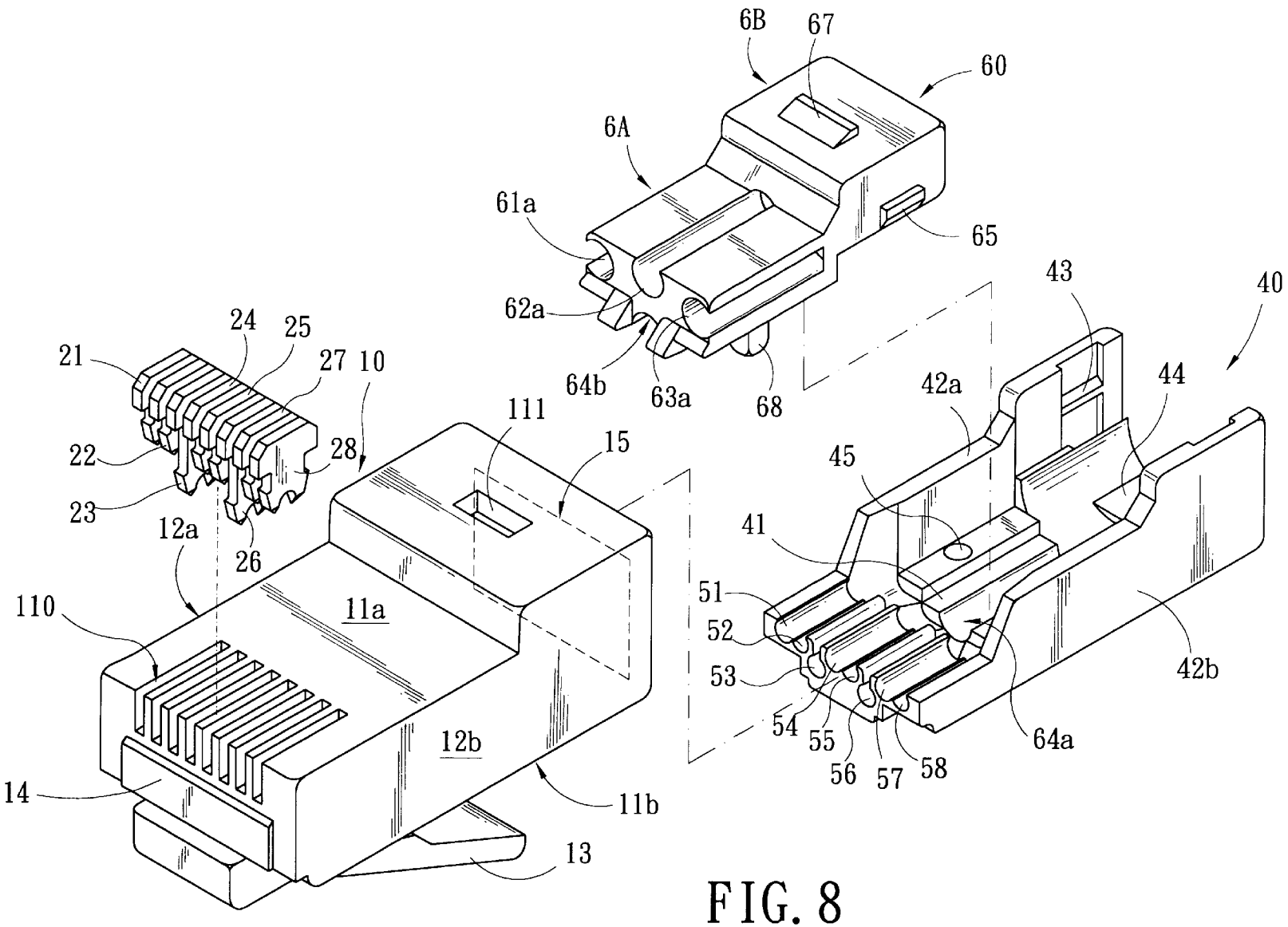
FIG. 8 is a cross section view of the clamping cap, showing the arrangement of tunnels.
Figure 9:
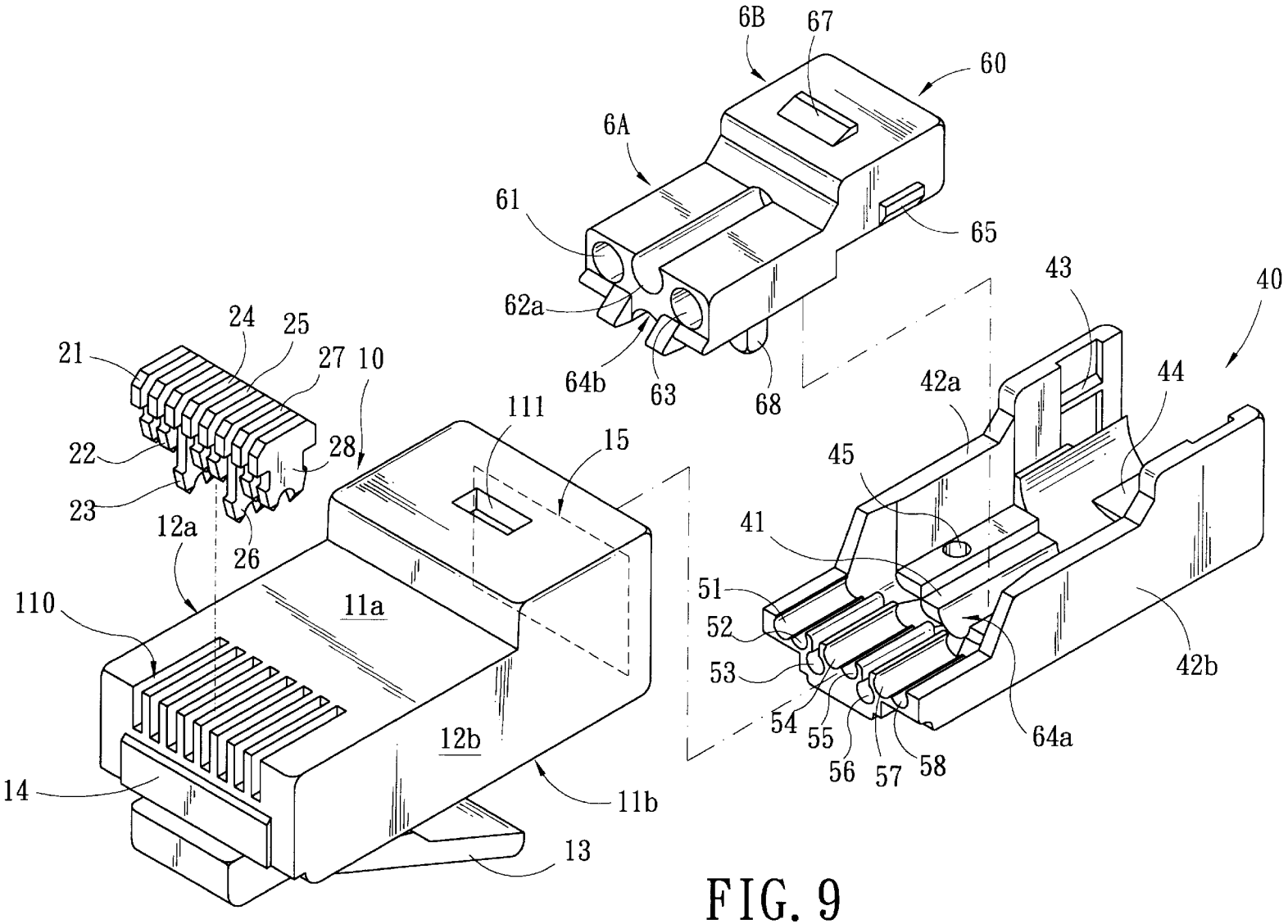
FIG. 9 is a cross section view of the clamping cap, showing another arrangement of tunnels.

Basically, the four tunnels 61–64 are located on different elevations, especially the fourth tunnels 64 is located on the level that different to the three tunnels 61–63. In the first preferred embodiment, the three tunnels 61–63 are located on same plane (i.e. same level, shown FIG. 1). In the other preferred embodiment, the three tunnels 61–63 are located on different plane respectively (shown FIG. 8–9).

According to the present invention, the three tunnels 61–63 not limited in the form as a tube (shown FIG. 1). In another preferred embodiment, each of the three tunnels 61–63 could be formed as a trough (shown FIG. 8–9).

Figure 10:
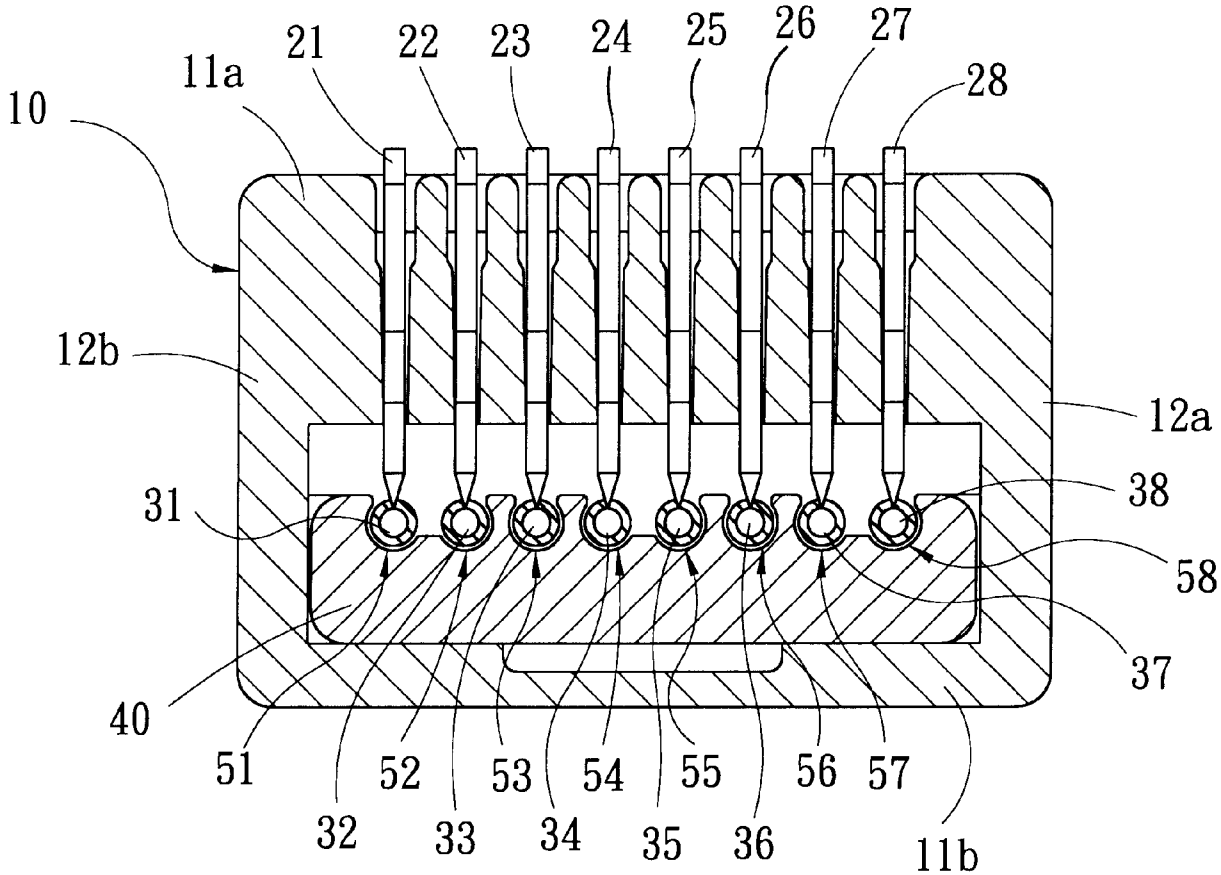
FIG. 10 is a cross section view of the invention, showing metal contacts connecting the cable lines on the same plane.

In a preferred embodiment, the line troughs 51–58 are located on different elevations, especially the line troughs 53 and 56 for holding the third pair of cable lines (Pair 3, which contains the third and sixth cable lines) has a lower elevation than the rest of line troughs 51, 52, 54, 55, 57, 58 (shown FIG. 1). In the other preferred embodiment of the invention, the line troughs 51–58 are located on same plane (shown FIG. 10).

Figure 6:
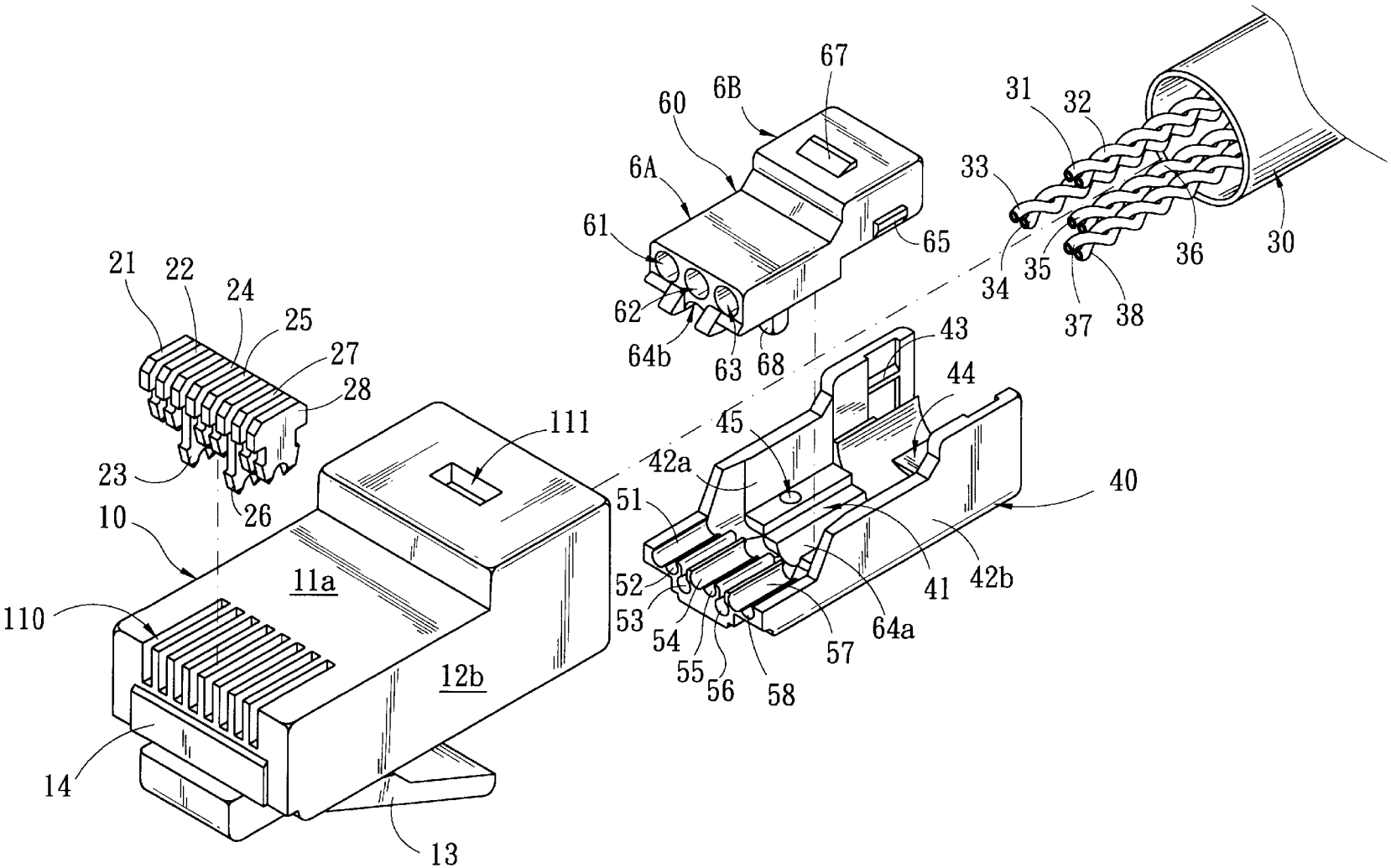
FIG. 6 is a schematic view for assembling of the invention, showing a method for assembling the high speed communication cable and the insert element.

Referring to FIG. 6, when connecting the connector plug 10 of the invention with the high speed communication cable 30, first, peel off the outer shrouding layer of the cable 30 to expose four pairs of twisted pairs (Pair 1–4) without separating the twisted pair lines of each pair, then channel respectively the twisted pairs 31 & 32, 34 & 35, 37 & 38 of the Pair 1, 2 and 4 through the tunnels 61–63 located on the upper level of the insert element, and dispose the twisted pair 33 & 36 of the Pair 3 below the upper guiding trough 64*b*, and move the insulation layer of the cable 30 between the clamp teeth 66 of the clamping cap 60 and the clip plane 44 of the cradle body 40, then couple the clamping cap 60 with the cradle body 40 together with the latch lugs 65 on two sides of the clamping cap 60 engaging with the latch notches 43 of the cradle body 40, thereby to clamp and hold the cable 30 tightly therebetween.

Figure 7:
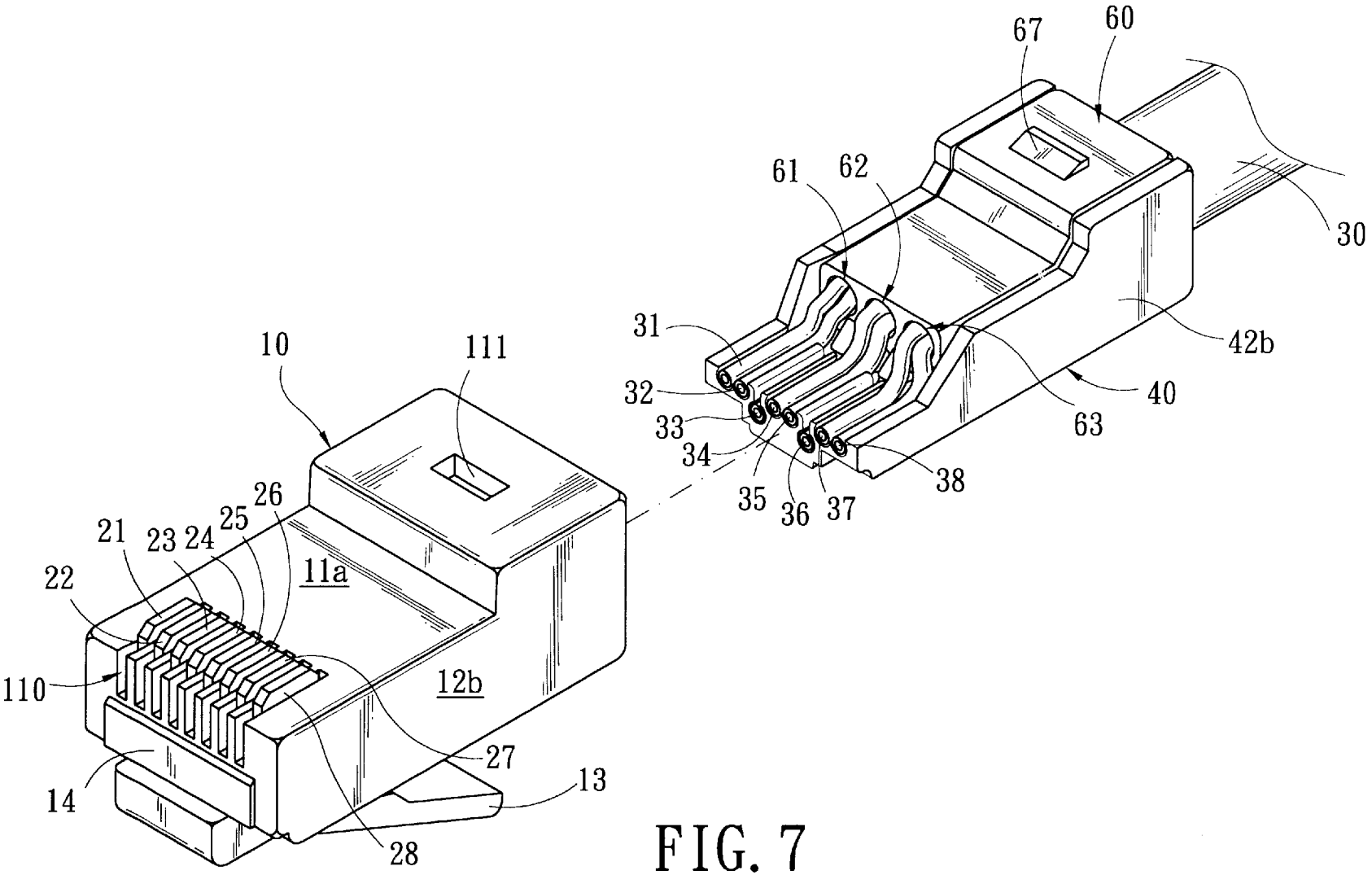
FIG. 7 is a schematic view for assembling the invention, showing the cable lines held in the line roughs after the high speed communication cable and the insert element are assembled.

It is to be noted, before the clamping cap 60 and the cradle body 40 are coupled, make sure that the ends of the twisted pairs 31–38, after passing through the tunnels 61–64, will be extended for a sufficient length to lay and expose on the line troughs 51–58. Then the insert element which has the cable 30 encased therein may be inserted into the plug casing 10 through the port 15 (shown in FIG. 7) until a snap latch 67 located on the top surface of the rear section 6B of the clamping cap 60 engaging with a matching latch aperture 111 formed on the upper wall 11*a* of the plug casing 10. Finally, insert the metal contacts 21–28 through the apertures 110 to make the pointed front ends of the metal contacts 21–28 connecting with the twisted pairs 31–38 of the cable 30.

In the invention, it is preferable to form the line troughs 51–58 of the cradle body 40 with upper openings cross section wise. The openings have a width slightly smaller than the outside diameter of each cable line 31–38 so that when the clamping cap 60 and the cradle body 40 coupled, besides channeling the cable lines 31–38 through the line troughs 51–58 in the axial direction, the cable lines 31–38 may also be straightened and depressed downwards through the openings into the line troughs 51–58.

To increase the clamping effect for the cable, the clip plane 44 of the cradle 40 may also be designed with the abrasive surface, or formed in an undulated or saw type profile. Such a design, coupling with the clamping teeth 66 of the clamping cap 60, can clamp the cable 30 tightly and the cable lines 31–38 can be held securely without slipping away even subject to force when the insert element is inserted into the plug casing 10. This also help to connect with the metal contacts 21–28 accurately. To further facilitate coupling of the insert element, the clamping cap 60 may have an anchor pin 68 jutting downwards from the bottom side, while the cradle body 40 has a mating cavity 45 to engage with the anchor pin 68 so that the clamping cap 60 may be coupled with the cradle body 40 more precisely and reliably.

In summary, through the guiding tunnel structure in the insert element of the invention, the multiple twisted pairs are separated only at locations closer to the metal contacts. Hence the invention can maintain the original design function of twisted pair to reduce noise and cross-talk. The design of deploying the twisted pairs on different levels can better achieve the high speed data transmission standard of Cat. 6.

Moreover, the design of two-piece insert element allows tight and secure clamping for the high speed communication cable before each twisted pair and the insert element being inserted into the plug casing, and can prevent the end section of the cable from retreating or skewing during assembly processes and achieve more accurate and reliable connection between the cable and metal contacts.

While the preferred embodiment of the invention has been set forth for the purpose of disclosure, modifications of the disclosed embodiment of the invention as well as other embodiment thereof may occur to those skilled in the art. Accordingly, the appended claims are intended to cover all embodiments which do not depart from the spirit and scope of the invention.

What is claimed is:

1. An electronic connector plug for high speed transmission for connecting a high speed communication cable, comprising:

a hollow plug casing with dimensions conforming to RJ-45 specifications having at least one end formed with a port, an elastic tab located beneath the bottom side thereof extending rearwards in a slant manner, a front end having eight metal contacts inserting therethrough to connect respectively with a plurality of cable lines of the high speed communication cable; and an insert element insertable into the casing through the port including a cradle body coupled with a clamping cap, and having four guiding tunnels running through the front end and the rear end of the insert element for channeling four twisted pairs of the high speed communication cable to line troughs formed on the cradle body; the clamping cap having a plurality of jutting clamping teeth formed on the side facing the high speed communication cable for clamping the high speed communication cable tightly between the clamping cap and the cradle body cradle when the clamping cap and the cradle body are coupled together.

2. The electronic connector plug of claim 1, wherein the cradle body has a front end closest to the casing and being extended forwards to form a plurality of line troughs which are located respectively below the eight metal contacts for holding different cable lines.

3. The electronic connector plug of claim 2, wherein the line troughs being located on different elevations, and the line trough for holding the third pair of cable lines having a lower elevation than the rest of the line troughs.

4. The electronic connector plug of claim 2, wherein the line troughs being located on same plane.

5. The electronic connector plug of claim 1, wherein the guiding tunnels for channeling three twisted pairs other than the third twisted pair are formed as a tube.

6. The electronic connector plug of claim 1, wherein the guiding tunnels for channeling three twisted pairs other than the third twisted pair are formed as a trough.

7. The electronic connector plug of claim 1, wherein the four guiding tunnels in the insert element include three tunnels running through the clamping cap on the same level for channeling three twisted pairs other than the third twisted pair.

8. The electronic connector plug of claim 1, wherein the four guiding tunnels in the insert element include three tunnels running through the clamping cap on the different level for channeling three twisted pairs other than the third twisted pair.

9. The electronic connector plug of claim 1, wherein the clamping cap includes a front section and a rear section, the front section having three tunnels running therethrough for channeling three twisted pairs other than the third pair of the high speed communication cable to the line troughs, the front section further having an upper guiding trough formed in the middle section on the bottom side thereof to couple with a lower guiding trough formed on the cradle body to form a fourth tunnel for channeling the third twisted pair, the clamping cap further having a plurality of jutting clamping teeth formed on the bottom side thereof to clamp the high speed communication cable tightly between the clamping cap and the cradle body when the clamping cap and the cradle body are coupled together.

10. The electronic connector plug of claim 9, wherein the cradle body has a clip plane formed on a surface opposite to the clamping teeth for matching the clamping teeth to clamp the high speed communication cable tightly between the clamping cap and the cradle body.

11. The electronic connector plug of claim 1, wherein the cradle body has a left side wall and a right side wall which have respectively a latch notch formed thereon for engaging with a latch lug located on two sides of the clamping cap.

12. The electronic connector plug of claim 1, wherein the clamping cap has a snap latch located on the top side thereof engageable with a latch aperture formed on an upper wall of the plug casing.

* * * * *